US008024903B2

(12) United States Patent
Riggs

(10) Patent No.: US 8,024,903 B2
(45) Date of Patent: Sep. 27, 2011

(54) DRYWALL CRACK REPAIR BACKING PLATE

(76) Inventor: Robert Eugene Riggs, Seguin, TX (US)

( * ) Notice: Subject to any disclaimer, the term of this patent is extended or adjusted under 35 U.S.C. 154(b) by 0 days.

(21) Appl. No.: 12/072,993

(22) Filed: Feb. 29, 2008

(65) Prior Publication Data

US 2009/0084062 A1 Apr. 2, 2009

(51) Int. Cl.
*E02D 37/00* (2006.01)

(52) U.S. Cl. ..... 52/514; 52/509

(58) Field of Classification Search ..... 52/514, 52/509, 514.5

See application file for complete search history.

(56) References Cited

U.S. PATENT DOCUMENTS

| | | | | | |
|---|---|---|---|---|---|
| 4,782,642 | A * | 11/1988 | Conville | 52/770 |
| 5,471,698 | A * | 12/1995 | Francis et al. | 15/144.1 |
| D420,281 | S * | 2/2000 | DiGate | D8/388 |
| 6,023,901 | A * | 2/2000 | Jensen | 52/514 |
| 6,088,986 | A * | 7/2000 | DiGate | 52/514 |
| 6,209,277 | B1 * | 4/2001 | DiGate | 52/514 |
| 6,245,415 | B1 * | 6/2001 | Keller et al. | 428/188 |
| 7,540,122 | B2 * | 6/2009 | Trudeau | 52/514 |
| 2006/0101765 | A1 * | 5/2006 | Bailey | 52/514 |
| 2008/0083185 | A1 * | 4/2008 | Lin | 52/514 |

* cited by examiner

*Primary Examiner* — Eileen Lillis
*Assistant Examiner* — Alp Akbasli

(57) ABSTRACT

A multi-perforated metallic base member device (the Backing Plate) that is used to repair stress cracks, or panel abutment joint separations in drywall boarding, thereby restoring and strengthening the repaired areas without the need to replace any affected sections, which is quickly and easily installed to the blind side of the cracked wall from the outside, by temporarily mounting it onto the (so called) locking hooks of its detachable installation member, (The Handle) thereby creating a living hinged assembly. Once mounted the base member may be pivoted over like a jackknife to be inserted into the wall cavity through a pre-cut slit in the crack, where it will spring open within the wall, to be pulled outward by the Handle and held in place against the blind side of the wall, while it is securely fastened to both cracked panel edges through the outside of the wall. The device may be applied at any desired area of the wall or ceiling framework, completely independent of rearward support from the framing members, thereby creating an artificial backing and a permanent mechanical bond between broken panel edges. Once the device is so installed, the handle may be released from its Locking Hooks by applying a simple hand squeeze. The handle may then be re-used to install multiple Backing Plates as needed. Paper or nylon mesh tape is then applied with a patching compound, sanded smooth, retextured and painted. With practice, nearly invisible crack repairs can be achieved by almost anyone.

12 Claims, 14 Drawing Sheets

DRYWALL CRACK REPAIR BACKING PLATE

CROSS-REFERENCE TO RELATED APPLICATIONS

References Cited

U.S. Pat. No. 4,782,642 11-1998 Conville, David 52/714
U.S. Pat. No. 6,023,901 02-2000 Jensen, Lars Dean 52/714
U.S. D420,281 02-2000 DiGate, John T. D8/388
U.S. Pat. No. 6,088,986 07-2000 Digate, John T. 52/514
U.S. Pat. No. 6,209,277 04-2001 DiGate, John T. 52/514
US-2006/0101765 05-2006 Bailey, Robert D. 52/514
US-2008/0083185 04-2008 Lin, Hon-Chang 52/514
U.S. Pat. No. 7,540,122 06-2009 Trudeau, Walter H. 52/514

Foreign Patent Documents

610386 April, 1979 CH 52/714
610386 February, 1991 Conville 246/191

STATEMENT REGARDING FEDERALLY SPONSORED RESEARCH OR DEV

Not Applicable.

THE NAMES OF PARTIES TO A JOINT RESEARCH AGREEMENT

Not Applicable.

BACKGROUND OF THE INVENTION (1) Field of the Invention
U.S. Class 052/514.

The present invention relates to a unique, hinged, metallic device for quickly and easily repairing cracks or panel abutment joint separations in wall or ceiling panels such as gypsum wallboard. More particularly, a device that can be used to repair a blind crack: one that cannot be reached from the rear of the wall or ceiling panel of a two sided wall. A device that can be inserted directly into the crack from the outside where it may be rotated and forcibly pulled flat against the rear "blind" surface and securely fastened in place from outside the wall. Further, a device that can be installed at any desired position along the expanse of the wall or ceiling framework, so doing without mechanical connection or support from the internal, spaced apart wall studs, ceiling joists, support columns or the like. When installed at spaced apart intervals along the crack, the device creates a permanent mechanical bond between the broken or separated wallboard panels, thereby restoring and strengthening the wallboard from the inside-out where the cracks begin.

(2) Description of Related Art; Present Methods:

Understanding Conventional, Stick Framing, by the Numbers

Basic "Stick Framing" generally consists of vertical framing studs (1) typically constructed of vertical 2×4 (38.100 mm×88.900 mm) or 2×6 (38.100 mm×139.700 mm) boards spaced apart at 16 or 24 inches (40.64 mm or 60.94 mm) intervals. The horizontal framing boards at the bottom (2) are called the "Bottom Plate." The top two horizontal framing boards are called the Top Plate, or Double Top Plate. (8) The top board of a Double Top Plate is fastened after the initial framing is constructed; it will overlap the Top Plates of the adjoining walls in order to lock the walls together. Both the bottom plate and top plate hold the walls together by various types of fasteners. The window and door frames will be cut-out (10), but will require compensation for the loss in structural integrity that would be present because of the missing vertical studs. Therefore the bottom of the window frame will be fitted with a Double Sill (9) fastened horizontally at the bottom. Next, Vertical "Cripple Studs" (5) will be placed under the Double Sill of a window to give it support. The window sills and door frames will require vertical "Jack Studs" (6) that are placed vertically on each side of the frame to provide support. A horizontal "Double Header" (4) of two 2×6 or 2×8 (38.000 mm×139.700 mm or 200.500 mm) boards will be sandwiched together and fastened to each side of the frame. The Header of the window or door, provided to strengthen the upper wall portions, will also be supported from underneath by fastening a Jack Stud at each side the frame. (6) "Cripple Studs" (5) will be installed vertically at the top of the Header to give support to the upper Top Plate Wall frames are normally constructed as assembled units, with the door and window "rough-ins" included. Each wall is then installed, squared and interlocked by the top board of the Double Top Plate. Finally, horizontal ceiling joists (7) (or roofing rafters in the case of a second or third story building) will follow to complete the framing. See Drawing FIG. 2.

Next, gypsum wallboard of various lengths is customarily nailed, screwed or stapled to the framing substructure. Using conventional methods of wall construction, a builder will typically align one edge of the wallboard with the central axis of a framing stud. In general terms, the ceiling panels will be installed first, with their edges butting up to the wall studs on all sides. The wall panels are installed next, beginning with the upper row of wall panels being placed and secured in such a manner as to press up against the ceiling panels, for upward support. The lower wall panels will be installed last. After the ceiling and wall board panels have been installed, the seams where each panel joins are typically sealed by using lengths of drywall joint tape and layers of joint compound. Almost everyone knows this procedure as, "Tape and Float." The seamed areas are smoothed by sanding, to prepare the entire surface for texturing and painting.

In summary, construction methods previously described would not ordinarily pose any problems over the lifetime of the structure. Normal foundation settling can be expected. However, due to extremely unstable soil conditions, (black clay based soil which expands when wet and contracts when dry) especially indigenous to many geographical regions, national and International, may cause a building's foundation to shift, causing the framed structure to move off square beyond allowable engineering tolerance. When such adverse conditions exist, stress cracks begin to form in walls and ceilings constructed of gypsum wallboard. The cracks usually begin at the corners of windows and doors (A), running up and out or (B) down and out. However, they may also extend upward into the ceiling, traveling across (D) or between ceiling joists (E). Straight running cracks on surfaces are usually separations of taped panel abutment joints (C), as evidenced by the appearance of loosened or warped paper taping and joint compound. See Drawing FIG. 3

Drywall gypsum boards have become the most widely used building material for use in numerous building interior walls, especially in residential homes because it is relatively inexpensive and easily installed. Unfortunately, drywall has a poor reputation for being weak and easily damaged or cracked by various means of unusual settling of the structure, or for other reasons. And, for as long as gypsum wallboard has been used in construction, wall and ceiling cracks have been a major problem for property owners to deal with. The cracks are aesthetically unpleasing to look at, and their presence will dramatically reduce the property's value. For these reasons it is the expressed desire of most property owners to repair the cracks in order to restore the wallboard in the dwelling to its original condition.

The simple method of making a quick crack repair would be to simply have another person place a solid object (a block of wood, etc.) on the back side of the wall or ceiling panel, while another person fastens it solidly in place through the wallboard on both edges of the crack with drywall screws, making sure that the screws are driven flush with the surface to assure a smooth finish, followed by Tape and Float, match texture and paint. The Smart and Easy way! Right?

However, when the wall to be repaired has two opposite sides, which is normally true in residential dwellings, the back side of the wallboard panel with the crack is hidden between the two panels which create an enclosed cavity. This makes it impossible for one to reach the crack to be repaired from the backside of the panel because it is hidden. Therefore, it is referred to as "the blind side." The real challenge is this: How could a person design a device that could deliver the required structural strength, and also be capable of reaching into the blind side of the wall from the outside to repair the crack? That is the real problem of which has not yet been solved, until now.

Although there have been several inventions brought to the market or that are pending, there are recognizable shortcomings, which will be addressed in these papers, the industry in general has attempted to approach this problem, primarily in only three known ways:

a) Tape and Float; that is to simply apply layers of drywall tape imbedded in several layers of a drywall patching compound, wait until each layer dries, sand the area smooth, followed by match-texturing and painting.

b) The Patch-Over Method; using any number of readily available patch variations presently being marketed, which also requires an amount of drying time between any applied layers, and the resulting "repair" is not much different.

c) The replacement method; that is to simply replace all of the affected drywall panels in the room or by cutting out only smaller sections to be replaced. Either way is the most radical approach that is usually cost prohibitive for many homeowners, in terms of labor hours and materials. It is also the messiest, environmentally unhealthy method known, especially for the occupants and their pets that usually have to vacate during the reconstruction. And it is a clean-up nightmare.

Some obvious drawbacks exist in both Tape and Float and The Patch-Over. a) The repair only treats the outer panel surface when the crack goes clear through to the inside. b) It is much like putting a band-aid on a deep laceration; the repair is cosmetic at best. c) The cracks will usually return, resulting in added labor and costs. d) The repair usually leaves visibly uneven material of some type on the surface.

The real truth is this: Tape and Float, or the Patch-over is NOT TRUE CRACK REPAIR. It is what should be done AFTER the repair; providing a person could actually "repair the crack."

Therefore, it must be recognized that there is a real need for a simple yet effective device that can be quickly and easily applied by almost anyone; such a device that can be inserted directly through the crack and placed within the cavity of the wall itself, where it can be pulled flat against the blind side of a wall, (that is the area within the wall that is typically covered by drywall on both sides) where it can be mechanically fastened to the inside of the drywall panel from outside the wall, and such a device that would leave no visible structure on the outer side of the wall; especially a device which would reinforce and strengthen the wall from the inside out; where the cracks begin. The present invention does indeed fill this very specific void.

Historically, there have been several mechanical or rigid device designs produced, which have made valiant attempts to solve the problem of how to make wallboard repairs within the inner surface (the "Blind Side") of a wall from the outer surface, by inserting the device through a pre-cut hole on the outside. This paper draws references to the more rigid type mechanical devices, which are designed to be applied through some kind of hole made into the wall. These devices will usually leave a portion of the device attached or appearing on the outer surface, which usually results in a finish that is uneven, or bumpy with ridges, or crowns that are visible to a person standing in the repaired room. These devices will usually lack the kind of structural strength that is required of any material device that would propose to be used to strengthen and fortify the cracked or broken wall panels.

I have made reference to several related patents, or pending patents, but I am only aware of one invention which might come close to solving the problem; that of how to design a device that could repair wallboard cracks from the rear of a panel on the blind side, while assuring maximum structural integrity. The example may be found in; Bailey, Robert D. (to be detailed).

(2) Description of Related Art; Cited References:

Examples of rigid repair appliances that are designed to be affixed through the outer surface of a wall include;

The above mentioned; Bailey, Robert D. US-20060101765. Bailey proposes a similar hand held multi-perforated device constructed from an injection molded plastic, or the like, material that includes a break-away yoke-like handle which is used to insert the device through a pre-cut slit or hole in the wall. Then using the provided finger pull-tab to pull the appliance outward, where it can be fastened to the blind side of the wall in the same manner as the present invention, while leaving no material exposed on the repaired surface. This invention also proposes a secondary proposed usage of the device; in that the user can leave the break-away handle attached to the device, where it can be used to hang pictures or such items on the wall; those items that would fall within the recommended maximum weight standards. The inventor indicates that the major design of this device is to "Patch Holes," but the device also appears to be useful repairing wall cracks or separations. Although this device does address the problem of making such repairs from within the wall's blind side, it does have a few serious drawbacks: The plastic type material is significantly weaker than such a device fabricated from steel material. When the installer attempts to drive hardened steel drywall screws through the drywall panel and into the securing holes or apertures of the plastic device described, there is the obvious potential danger of stripping out the plastic holes. Also, the surface of the plastic device is flat on both the top and bottom, making it a flexible device that is lacking the type of steel-ribbed reinforcing strength that is afforded by the present invention; therefore it lacks peripheral edgewise support on both sides of the broken panel, as well as the clamp-like support which would add strength to the repair. The plastic disclosed invention is simply not strong enough to repair cracks.

Another example can be found in U.S. Pat. No. 4,762,642, issued to Conville, David J. (11-1988). This design comprises a perforated metallic clip, which includes a pair of parallel reinforcement ribs, further comprising rounded corners for enhanced handling. This clip also includes a pair of upward bent clip-on tabs which are designed to be clipped onto the edges of wallboard panels during construction to hold it in place, when it is desirable to join two or three wall panels. After the one side of the clip has been put in place, drywall screws are driven through the panel edge and into the perforated plate from the outer surface. The second or third panel is then put in place, followed by blind fastening its edges to the clip from the outer surface in the same manner. Once so installed, the clip-on tabs may be broken off by bending them along a weakened score. The result provides a bump-free surface that can be smoothed over by joint tape and a patching compound. The method and device is very similar in appearance and application as the present invention; with the exception of having the clip-on tabs. The Conville Clip has a secondary usage; that of repairing holes or other damages, by means of the worker cutting out a squared section around a hole, fastening several of the clips around the open panel edges, then cutting a replacement piece to be placed over the opening. Again, drywall screws are blind fastened through the clip to attach the replacement piece. The Conville Clip does have many of the same features and application as the present invention, in that it also provides a strong mechanical bond that is independent of framing members. However, the expressed purpose of the invention has never been to make repairs of cracks or separations in wallboard panels, in the same manner as the present invention.

Note to the Examiner: The reference to the Following patents of DiGate, were brought into the examples by the examiner, even though they share little impetus to the usage and construction in this paper.

U.S. Pat. No. 6,209,277, that was issued to DiGate, John T. in 02-2000; the disclosure of a wallboard clip, to be used for repairing impact dents or holes in wallboard, that comprises a metallic clip device that is bent into a triangular shape: a device that can be applied around squarely cut-out sections, clipped onto the open cut-out without the use of screws, where a replacement piece can be snapped into place. The main drawback to the device is that a portion of it needs to remain on the outer surface; a surface that results is a visible bump or ridge. Further, the device cannot be inserted into a crack and blind secured to the inner surface. Likewise, U.S. Pat. No. 6,088,986 also issued to DiGate, John T. 07-2000 is a duplicate device in appearance to the above device, but adapted to repair or join wallboard of different thickness. Another relative duplicate device with slightly altered parts and usage, under. U.S. Pat. No. 6,209,277 was also issued to DiGate, 04-2001. The added patents referenced above are basically duplications, so they will not be fully discussed at this point. Never the less, the device introduced in DiGate is only useful in joining or rejoining panel pieces, and are not truly capable of being used to repair cracks in drywall.

Still, another U.S. Pat. No. 6,023,901, issued to Jensen, Lars Dean, of 02-2000, Discloses a metallic Jack that is self drilling; a device that resembles what is called, "A Molly-Bolt," one that has a long threaded screw (measured by the distance between both inner wall surfaces) leading through a type of metallic butterfly, which the user can fold backward and insert it into a finger-sized square hole cut into the repair area, to be placed within the wall, under the damaged wallboard. The outer end of the screw includes a flat bladed screwdriver slot, wherein a screwdriver can be used to turn the screw. As the screw is turned, its base (which is fitted with a small cylindrical foot at the end) within the wall is forced to press outward on the drywall board on the opposite side of the wall. As the user continues to turn the screw, the "Molly Bolt" butterfly piece will rise outward in the direction of the outer wall, which acts like a car jack to force the dented wall to also move outward into its original flush surface on the outer wall. The head of the screw having the slot will now be retained just under the surface. A drywall compound then can be used to fill in and bond the repaired surface. This device could possibly be used to repair cracks by placing one at even spaced apart locations. However, it is only capable of pushing out upon the single inside wall surface, and does nothing to support and strengthen the wall from both the inside and outside surfaces. Therefore, the device is useless as a crack repair tool.

In another example, US-2008/0083185, issued to Lin, Hon-Chang, 04-2008, it discloses a Wall Hole Patch that includes a threaded rod pushed through a folding in umbrella-like element, including a string attached to the inside of the threaded rod, which also has a removable installation sleeve of sorts. In installation, a rounded hole is cut into the wall in the damaged panel area, allowing the "umbrella" device to be inserted into the hole and placed within the wall cavity. A small "U" shaped chair-like mounting stand is placed over the hole and rod, with its feet resting on the panel surface. The sleeve on the installation rod is removed, allowing the string to be wrapped around and tied to the top of the mounting stand. The repaired area is then coated with a few layers of a joint compound. This device has a number of drawbacks as well: a.) It only provides support for the inner side of the panel, failing to strengthen the outer surface. b.) It is too complex to set-up for use. c.) The user must wait until the patching compound dries between each layer. d.) It fails to provide the required strength to fortify the wall.

In the final example, U.S. Pat. No. 7,540,122, issued to Trudeau, Walter J., discloses a Drywall Repair Tool and Method, which is used to repair localized defects in drywall, by providing a conical shaped abrasive boring tool, which includes a circular cutting rim. The tool may be chucked onto a variable speed drill, where it can create a conical hole; a hole in which the inner diameter is smaller than the outer diameter. A supply of conical plugs equal in size to the boring tool has been provided as part a kit for this device. Thusly, the replacement plug is to be "buttered" with a patching compound and inserted over the hole left by the cutting tool. The device can be effective for repairing dents, or the like, but even though it shares a mutual classification that doesn't truly apply to the present invention, it does deserve mention within these pages. Therefore, it must be concluded that this device is useless to anyone who is attempting to repair drywall cracks.

SUMMARY OF CITATION REFERENCES

Because each of the proposed solutions has various shortcomings as discussed in the above referenced matter of coverage, and because none of those mentioned can effectively act as a structurally strong backing, there is indeed a great need for a drywall crack repair device that can easily be mechanically fastened to the blind side of the wall within the dry-wall hollow; such a device that will leave the outer surface indiscernibly finished, and one that can be applied by almost anyone.

The present invention affords a simple user friendly and convenient mode whereby drywall cracks or separated panel abutment joints can be successfully repaired. It would create a permanent artificial backing that is primarily independent of rearward support from nearby framing members. It can be randomly employed in multiples as needed at any given point along the expanse of the wallboard surface. It can easily be used by almost anyone; and with practice, practically invisible repairs can be achieved.

BRIEF SUMMARY OF THE INVENTION

The Objects of the Present Invention are

It is the fundamental object of the present invention to provide a wall and ceiling crack repair device (the Backing Plate and Handle) which will effectively repair the cracks from within the confines of the unreachable areas between the walls and ceiling framework, to strengthen, fortify and restore the structure to its original condition. Thereby enhancing its appearance, and, improving its value.

To accomplish this objective it is a further object of this invention to provide a rigid metallic reinforcement device that is fitted with a detachable, hinged, installation handle that can allow the device to be inserted into the cracks within the confines of the inner cavity between the walls, where it can be rotated and pulled flat against the inner surface where it can be fastened in place from the outside surface by fasteners that will leave a smooth finish.

Another object of the invention is to provide a device that will create an artificial backing that will give rearward support and strength for the original wallboard panels without the necessity of replacing wallboard sections or full panels; thereby saving the great expense of added labor, materials and cleanup.

Yet another objective of the invention is to provide a permanent mechanical bond between cracked or separated wallboard panels that can be applied at any location along wall or ceiling framework, independent of nearby framework.

Further, it is an objective of the invention to provide a means of installing the Backing Plate with the use of a special Detachable Handle which creates a pivoting hinged installation assembly that has only two moving parts when so joined; providing a repair device that is user friendly, with simplicity of construction.

Another objective of the invention is to provide a quick and easy method of making wall crack repairs that can be accomplished with the least amount of time and inconvenience to the property owner.

Another object of the invention is to provide a means for making wall and ceiling repairs which can be quickly and conveniently accomplished by both the professional as well as by the do-it-yourself market without having specialized skills.

Another fundamental objective of the invention is to provide a means of making repairs that is clean, and environmentally safe. Rather than having resort to radical wallboard replacement.

It is also an objective of the invention to provide a new product line and market for the manufacturer, wholesalers and retailers.

Likewise, another objective of the invention is to provide a new means for the professional contractor to generate profit from a specialty trade service by using a repair device that is simple to use, efficient, and cost effective.

Further, it is an objective of the invention to provide the specified Backing Plate and the Handle to be packaged in such a structure which can be combined with an after-market repair "Kit" for quickly finishing broken, cracked, or separated dry wall, gypsum wallboard, Sheet Rock-brand drywall board or the like by the "do-it-yourselfer."

It is further an objective of the invention to provide a repair method, with mechanical parts fabricated from materials which that meet all building codes and fire regulations because it cannot be incinerated.

Finally, it is the foremost objective of the invention to provide the solution to the age old problem of how to effectively and easily repair wallboard cracks from within the hidden confines of walls covered with opposing wallboard panels.

These and other objects or advantages of the present invention will become apparent based upon the specification that accompanies the drawings set forth by means of examples and illustrations specifically carried out by this paper. More specifically, the evidence presented will, hopefully, prove the patent worthiness of this invention in order to help make the long sought after solution a reality.

BRIEF DESCRIPTION OF THE SEVERAL DRAWINGS

FIG. 1 shows an assembled perspective that illustrates how the Backing Plate is inserted into the slit in the crack with the use of the attached Handle. The drawing also shows the numbered primary parts.

FIG. 2 provides a fragmentary Ex-Ray view of a partially constructed wooden "STICK FRAME" wall of a building which describes its primary parts as follows:

1. COMMON STUD
2. BOTTOM PLATE
3. DOUBLE END STUD, DRYWALL BACKING
4 HEADER
5. CRIPPLE STUD
6. JACK STUD
7. CEILING JOIST/RAFTER
8. DOUBLE TOP PLATE
9. DOUBLE SILL
10. DOOR CUTOUT

FIG. 3 provides an EX-RAY view illustrating the locations of typical cracks and panel separations purely for the purpose of providing a better understanding of the anatomy of wallboard cracks, of explanations with alphabetical characters as follows:

A) Cracks extending upward from a wall at the corners of windows or doors

B) Cracks extending down from the corners of windows, across or between studs.

C) Separations of taped panel abutment joints on wall surfaces.

D) Cracks running up and out from window or door corners that continue to run into the ceiling panels, then traveling across ceiling joists.

E) Cracks running up and out from windows or door corners that continue to run into the ceiling panels, then traveling between ceiling joists.

Note: In FIG. 3, in the "B" type crack illustration, the crack running down from the right side of the window gives an example of how a crack may extend longer than 16 or 24 inches (40.64 to 60.94 cm) between studs, without nearby support.

FIG. 4 is an isometric view of The Backing Plate with the detachable and the functional parts numbered and described:

11. BACKING PLATE, PRIMARY MEMBER
12. REINFORCEMENT RIB X TWO ON EACH END
13. LOADING GUTTER
14. PIVOT LOOP, LEFT SIDE
14A. PIVOT LOOP, RIGHT SIDE
15. SECURING HOLES; SET OF MULTI-PERFORATIONS EACH END.
16. ROUNDED CORNERS, ONE EACH CORNER
17. LEADING EDGE WHEN LOADED
17A. TRAILING EDGE WHEN LOADED
18 RIGHT EXTENSION ROD
18A LEFT EXTENSION ROD
19. LEFT HOOK
19A. RIGHT HOOK
20. THUMB OR FINGER GRIP, LEFT SIDE
20A. THUMB OR FINGER GRIP, RIGHT SIDE
21. PULL RING, PRESSURE SPRING

22. THE HANDLE; DETACHABLE INSTALLATION MEMBER

Figure 7:
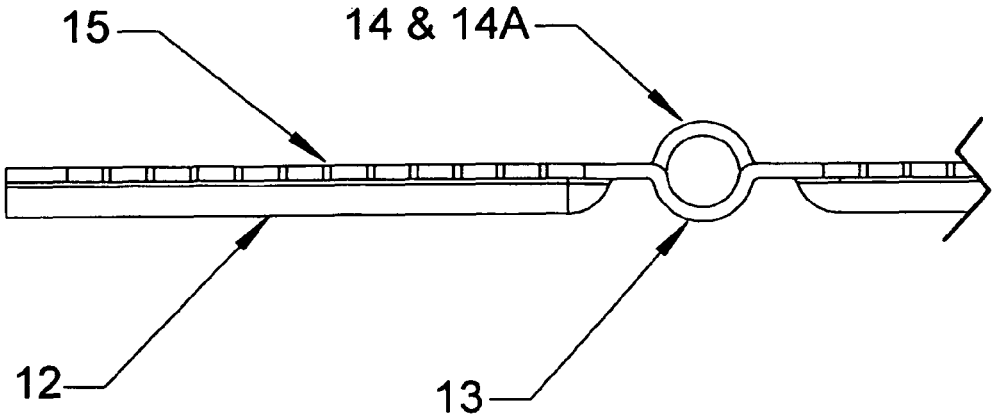

FIG. 7 provides an enlarged cut-away side view of the Backing Plate which dramatically illustrates how the Pivot Loops (14 & 14A) and its Gutter (13) form a perfect cylinder completely through the other side, to allow it to pivot freely on the Locking Hooks of the Handle.

Figure 8:
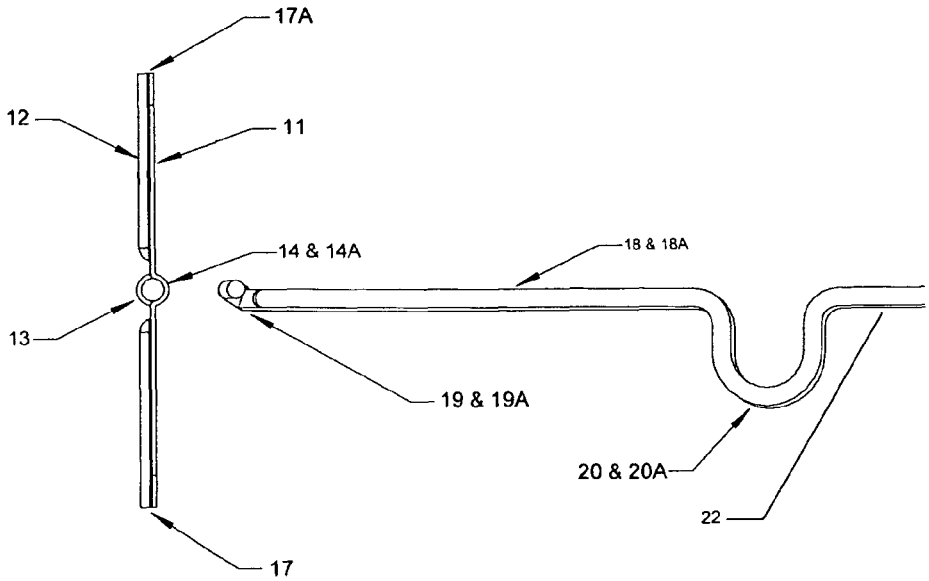

FIG. 8 illustrates how the Locking Hooks of the Handle (19 & 19A) are slightly bent upward, to allow the Primary Support Pad of the Backing Plate (11) to lie flat against the Extension Rods (18 & 18A).

The General Preparation Steps, the Drawings Described

IMPORTANT NOTE: The general preparation steps illustrated in the drawing figures (FIG. 9 through FIG. 14) demonstrate only the general steps that are needed to make in order to assure the basis for a stronger crack repair, following the steps is highly recommended in order for anyone to achieve a repaired finish which is smooth as possible. However, the final step of cutting a lengthwise slit into the crack is an essential step otherwise the Backing Plate cannot be inserted into the crack.

Figure 9:
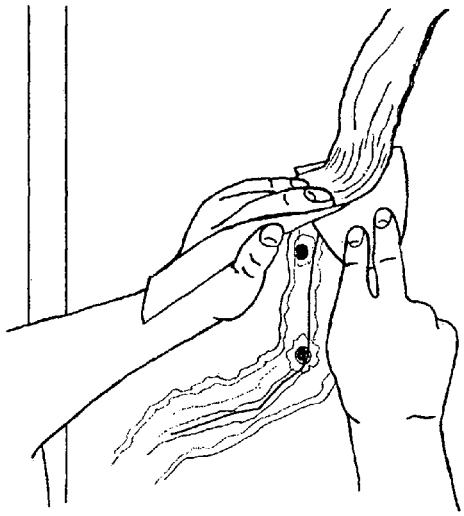

FIG. 9 illustrates how to peel and scrape away any previous taping and joint compound layers to smooth the surface.

Figure 10:
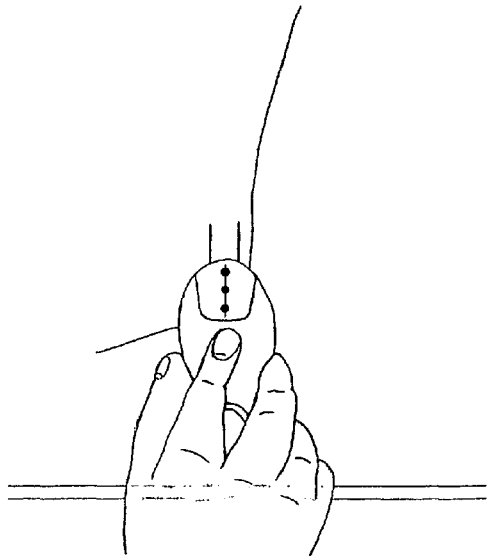

FIG. 10 illustrates how to use an electronic stud finder to locate and mark each stud for re-securing each side of the broken panel for support and leveling.

Figure 11:
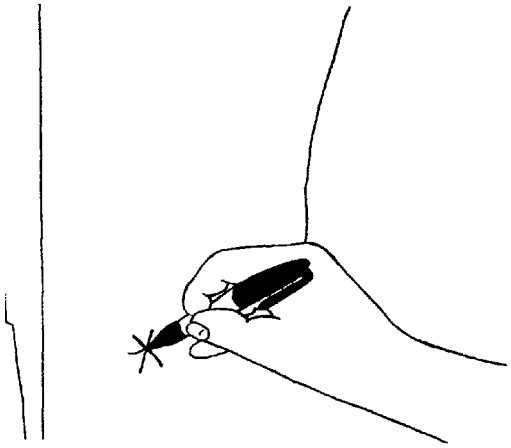

FIG. 11 illustrates how to use a marker to draw a line along the length of the crack, placing ax "X" at its termination point.

Figure 12:
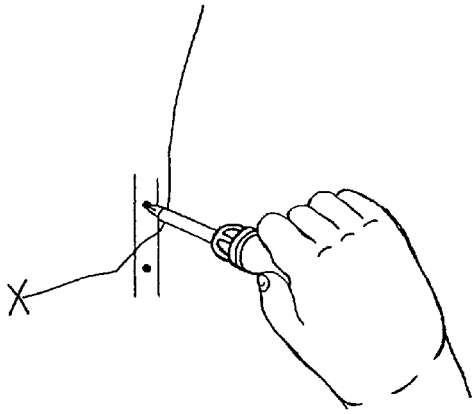

FIG. 12 illustrates how to re-secure and support the cracked panel edges against the stud, using course thread drywall screws.

Figure 13:
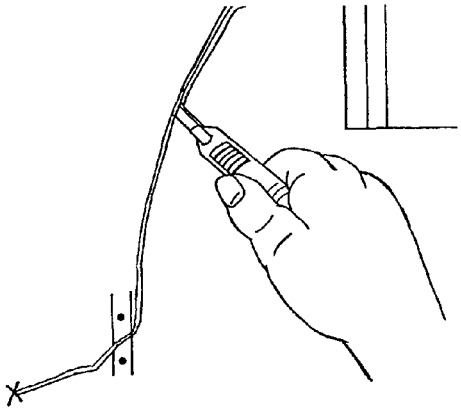

FIG. 13 illustrates how to cut a "V" groove into the panel surface along the length of the crack, to provide a better joint compound base.

Figure 14:
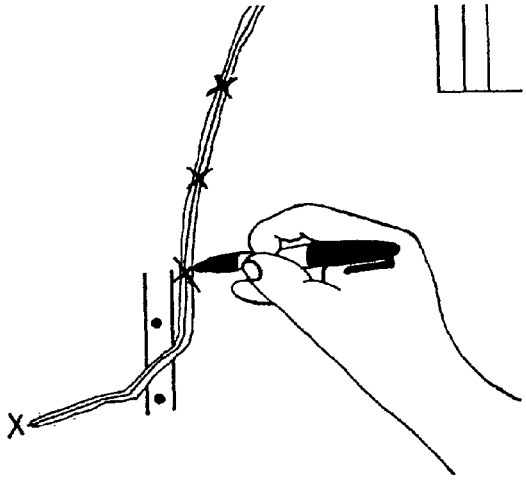

FIG. 14 illustrates how to mark repair target points at four inch intervals between the studs.

Figure 15:
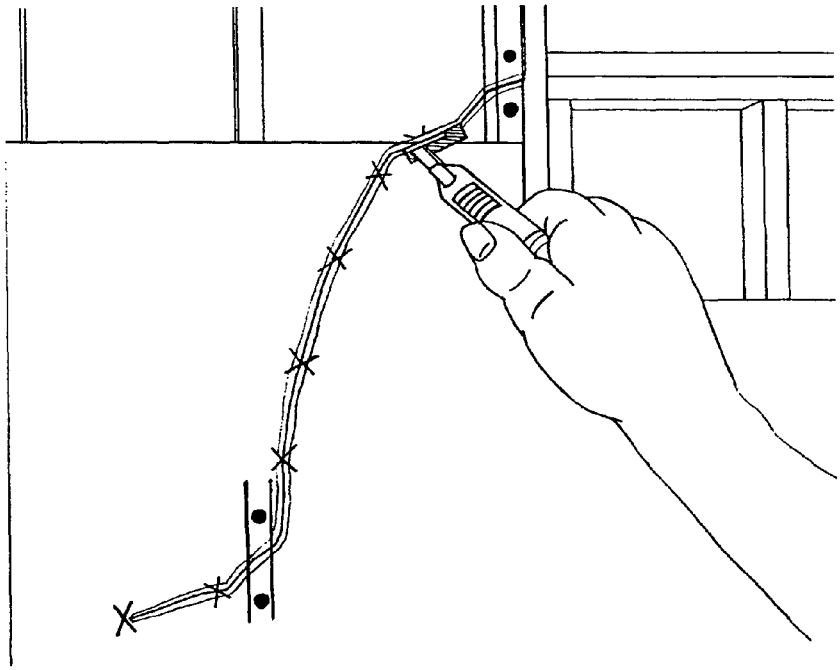

FIG. 15 illustrates how to cut a lengthwise slit into the cracked panel at each repair target point.

Figure 16:
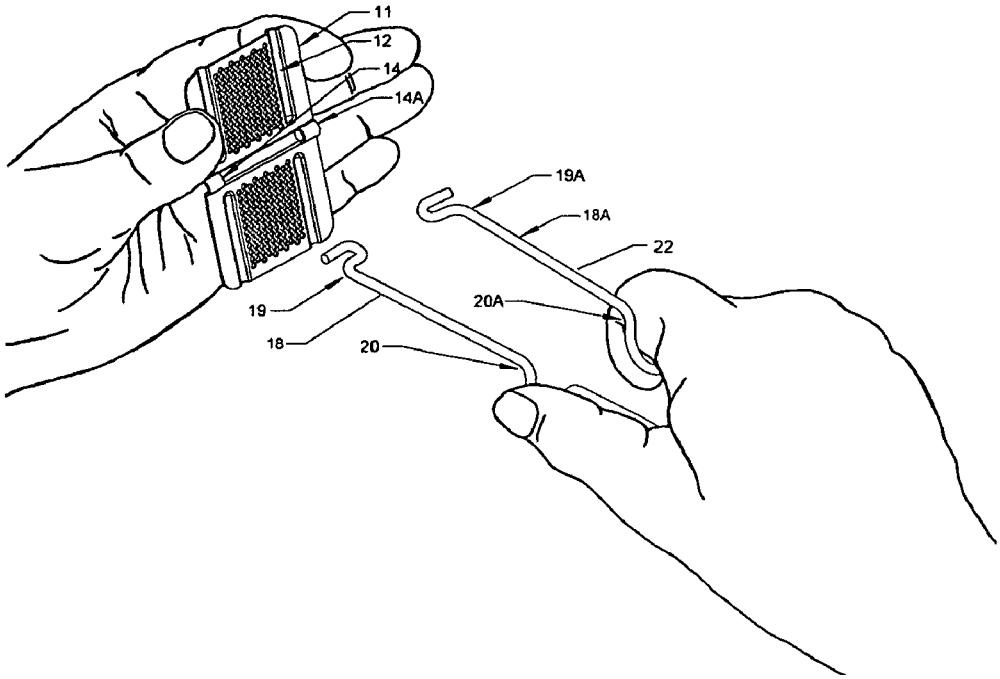

FIG. 16 illustrates how to hold the Backing Plate in the palm of one hand with its Pivot Loops facing outward, while holding the Handle in the other hand while squeezing its Forward Extension Rods together and aiming the Locking Hooks toward the Loading Gutter of the Backing Plate.

Figure 17:
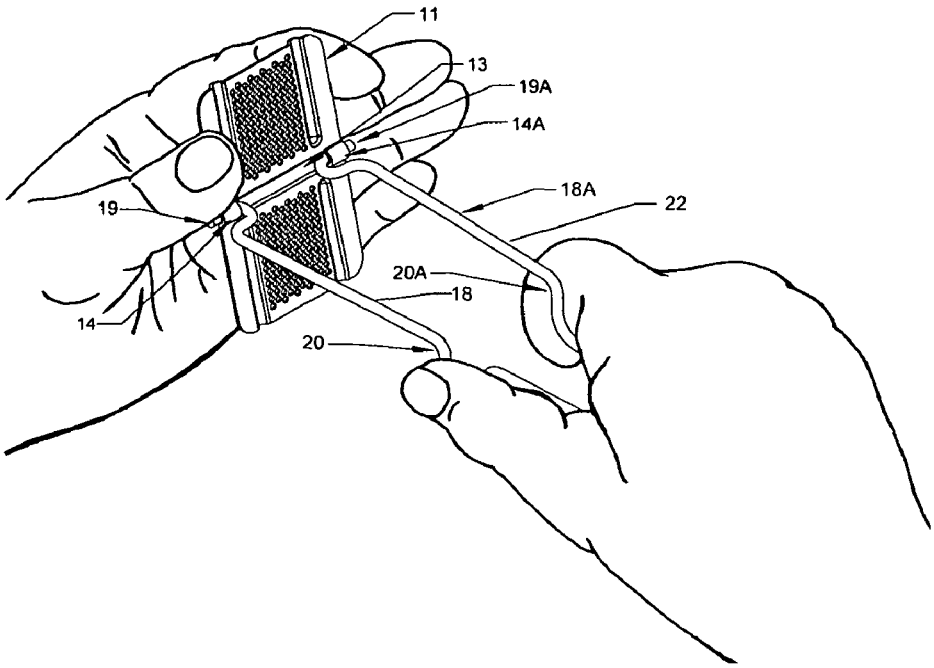

FIG. 17 illustrates how to lock the Loading Hooks of the Handle into the Pivot Loops of the Backing Plate hold the Backing Plate, by pressing the Locking Hooks against the Loading Gutter of the Backing Plate, then releasing hand pressure.

Figure 18:
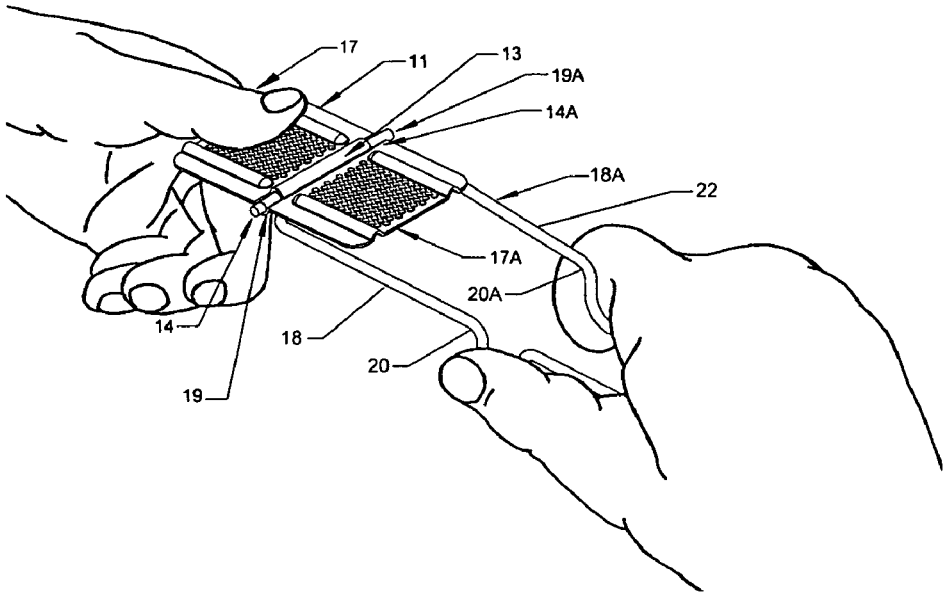

FIG. 18 illustrates how to fold the Backing Plate backward by its hinges to be folded backward against the extension rods of the handle into its ready position.

Figure 19:
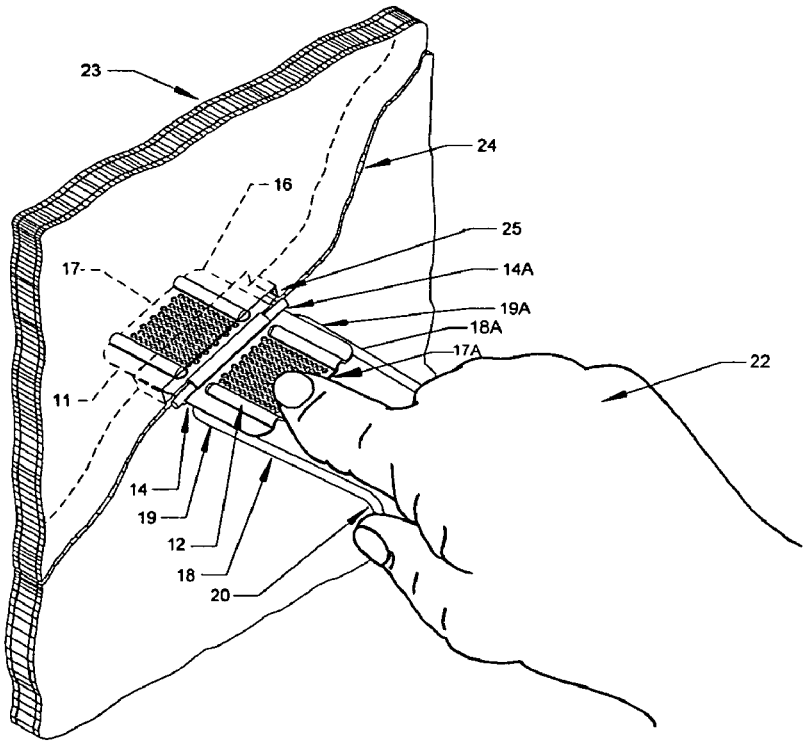

FIG. 19 provides a cross-sectional perspective view that demonstrates how the Backing Plate is being inserted into a wallboard crack with the use of the Handle while its Trailing Edge (17A) is being pressed downward with the use of the index finger or thumb of the one hand to compress it into a low profile that will better assist its complete passage through the crack.

Figure 20:
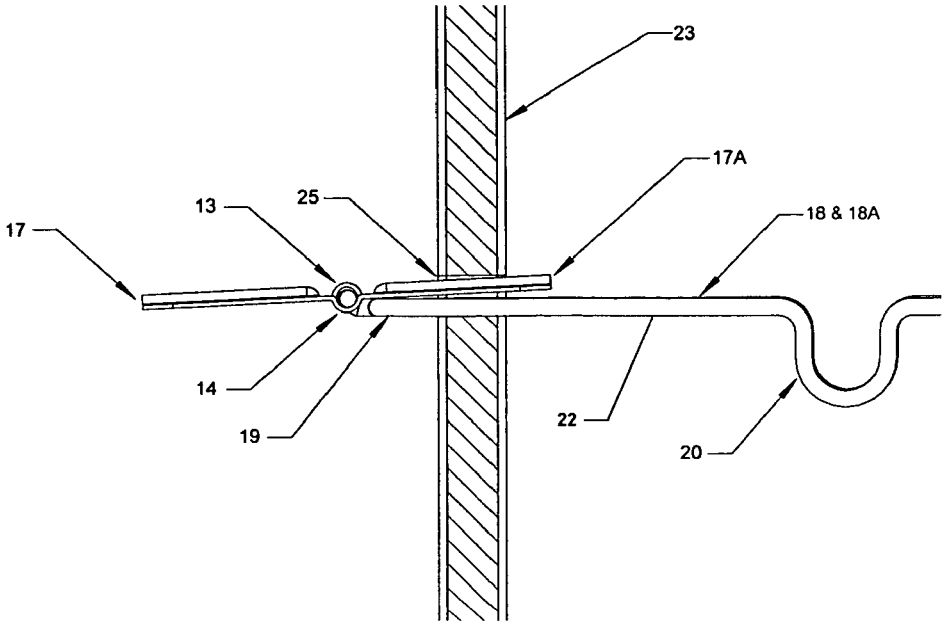

FIG. 20 provides a cut-away Ex-Ray view that dramatically shows how the Backing Plate will compress fully as it is being passed through the pre-cut slit in the crack.

Figure 21:
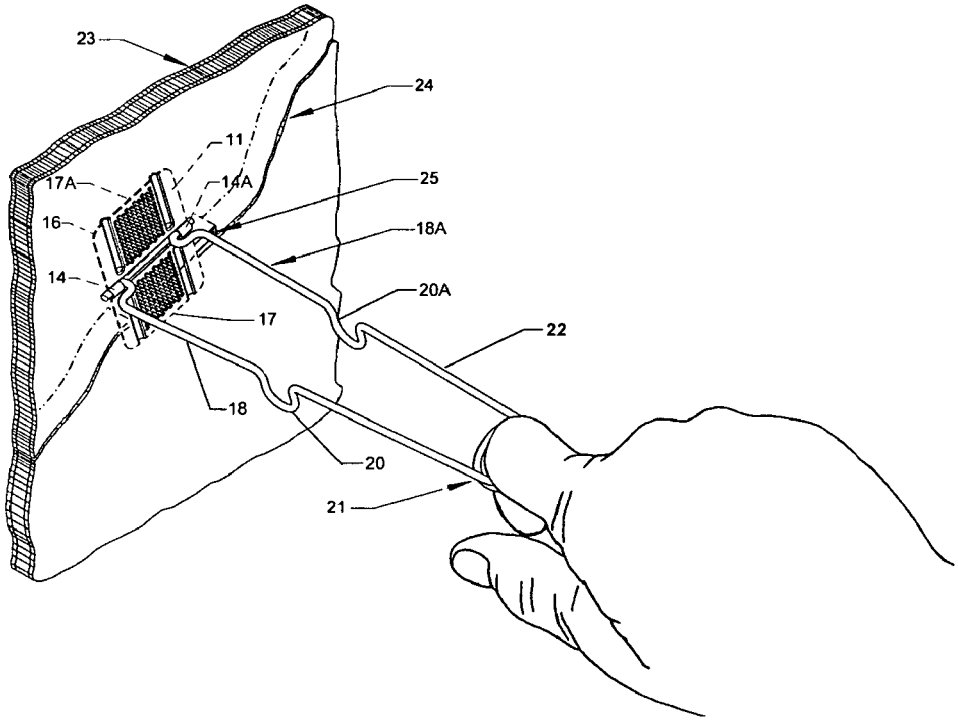

FIG. 21 also provides a perspective Ex-Ray view that dramatically illustrates how the Backing Plate is being pulled outward against the inner side of the wallboard.

Figure 22:
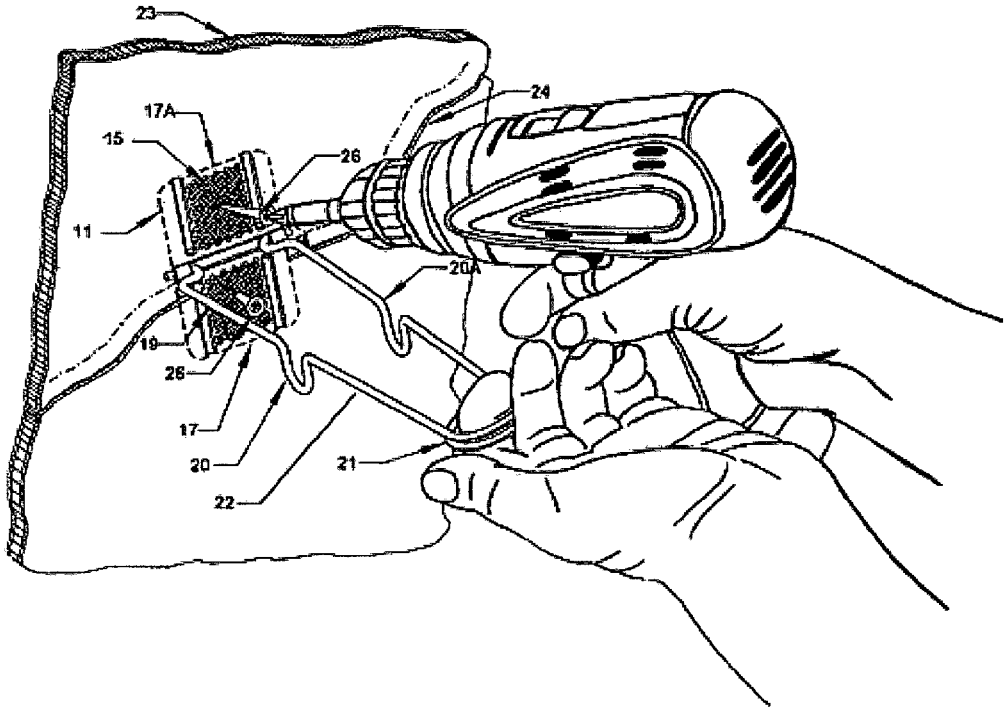

FIG. 22 provides a perspective view that shows how the Backing Plate is being forcibly held in place against the inside of the drywall panel while it is being securely fastened in place by drywall screws; first in the lower end of the Backing Plate, followed by placing another screw in the upper side.

Figure 23:
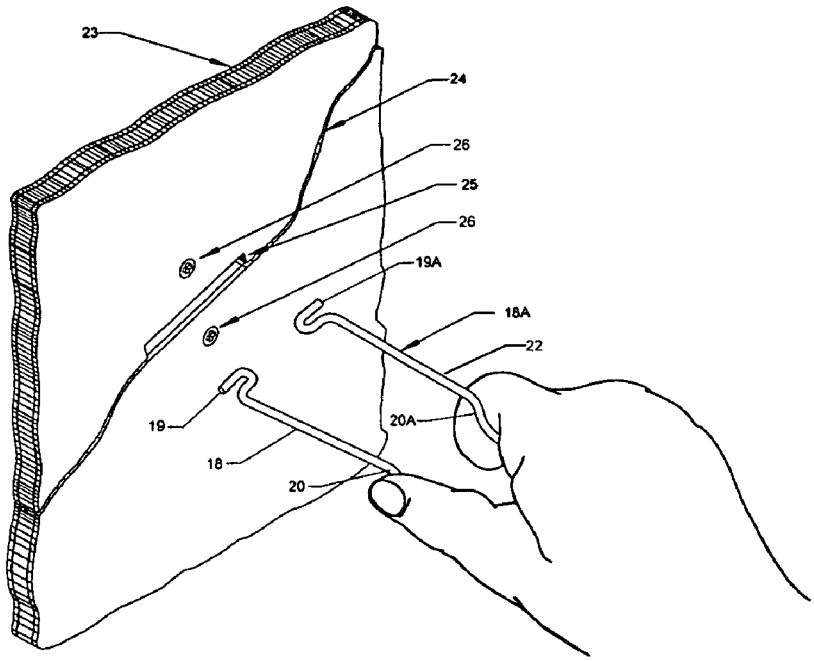

FIG. 23 is also a perspective view that illustrates how the Handle has been released from the Pivot Loops of the Backing Plate, after the drywall screws have been tightly turned to make them flush with the outer surface. The Handle is now ready to be used to install additional Backing Plates at locations along the crack as needed.

Figure 24:
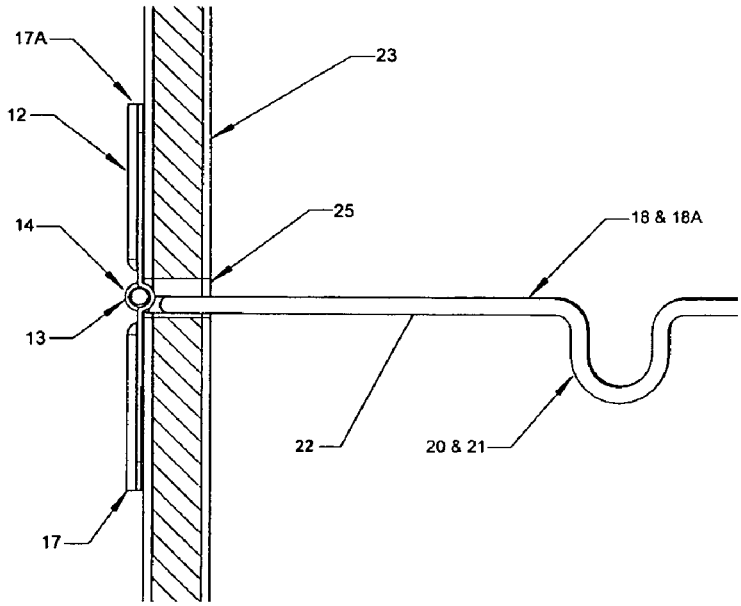

FIG. 24 provides a cut-away side view ex-ray that further illustrates how the Backing Plate has been pulled flush against the wallboard's rearward surface. Notice how its Pivot Loops have been automatically aligned within the prepared slit, in order to help it remain centered within the crack, further adding to its strength.

Figure 25:
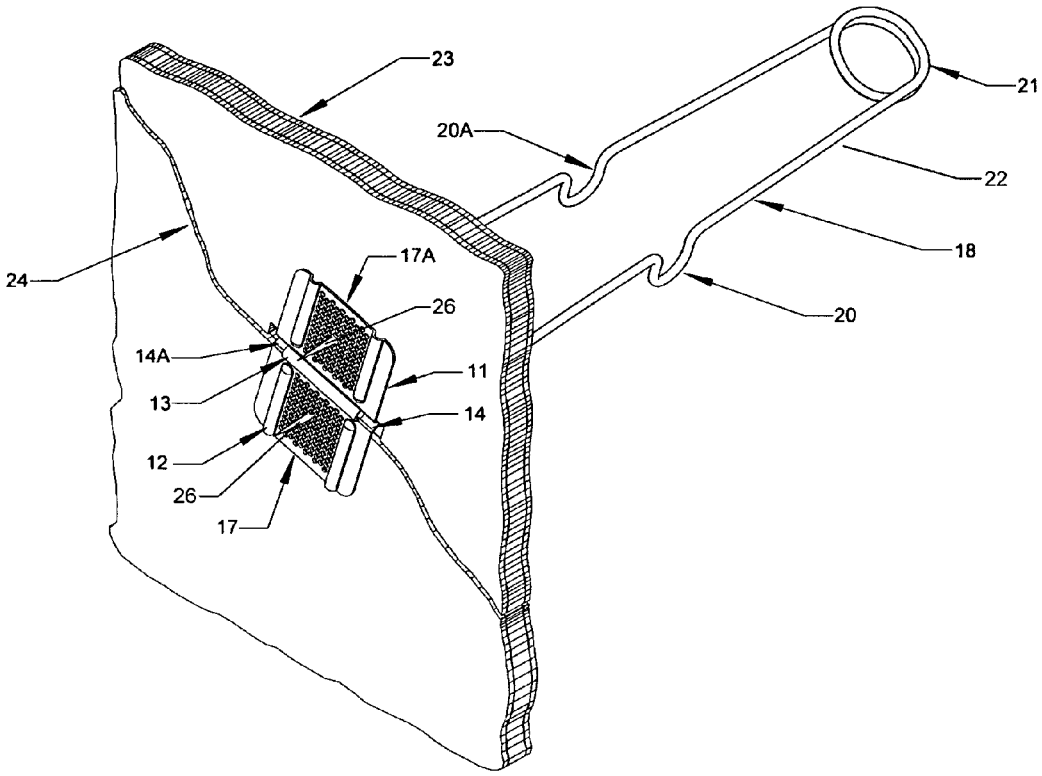

FIG. 25 provides a perspective rearward view that better illustrates the securely fastened position of the Backing Plate against the wallboard panel.

Figure 26:
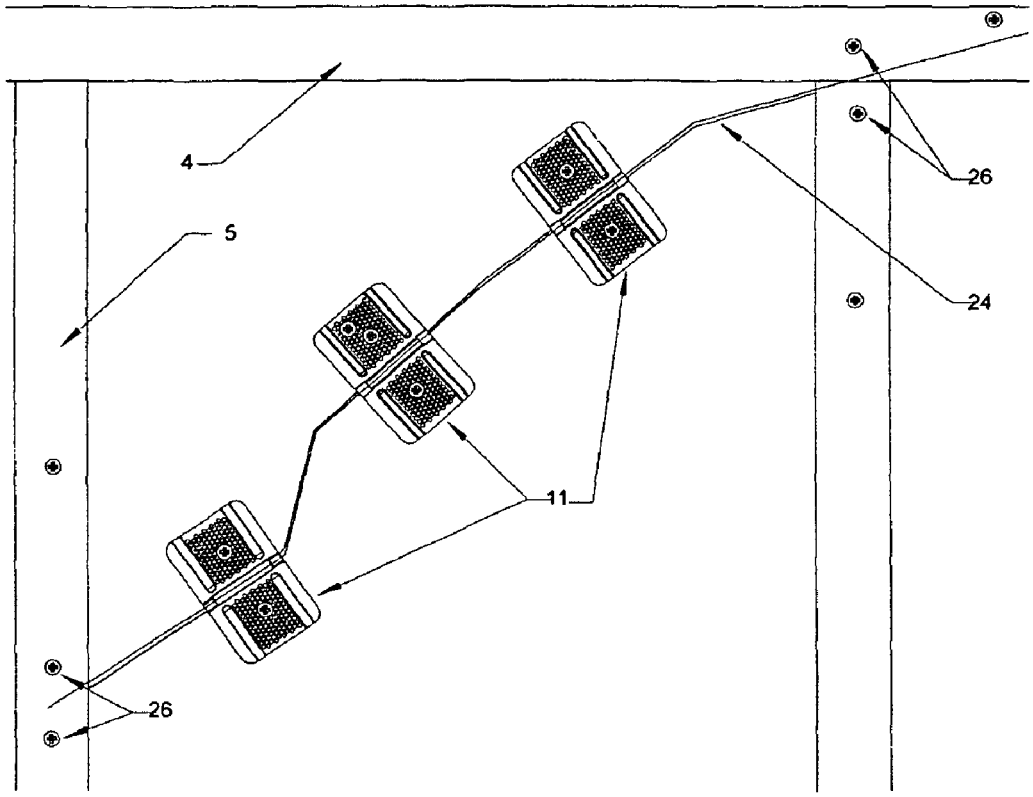

FIG. 26 is an ex-ray view of a wall section that shows how the Backing Plates may be installed at spaced apart locations along the crack. Notice also how the cracked wallboard edges have been firmly secured against the wall studs wherever the crack crosses, by installing drywall screws. (26)

Figure 27:
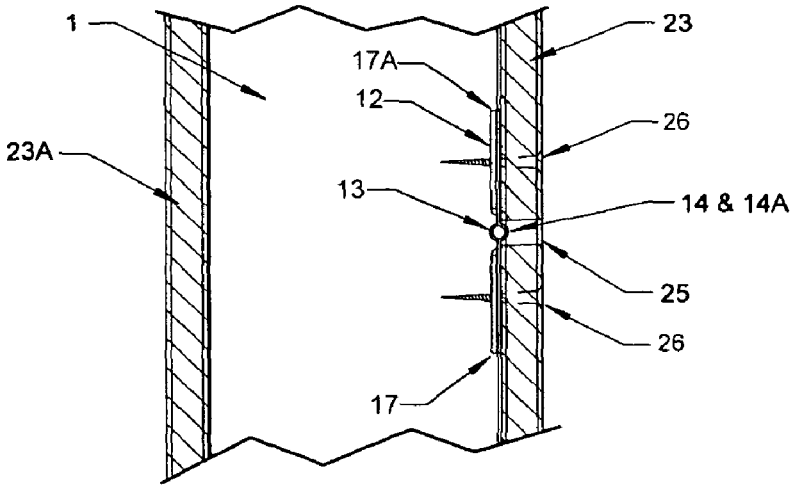

FIG. 27 is a cut-away ex-ray view that shows the position of an installed Backing plate as it has been placed on the "blind side" of the wall within the confines of the cavity formed by the wallboard panels. (23 & 23A).

DETAILED DESCRIPTION OF THE INVENTION

Note: The following descriptions will point out various optional configuration allowances of the present invention, so long as the overall integrity of the invention characteristics and objectives will not be compromised. Such allowances will appear as noted by the wording: "Alternately."

Please refer to the drawing figures of; FIG. 1, FIG. 4, FIG. 5, FIG. 8, FIG. 16, FIG. 17, FIG. 18, FIG. 19 and FIG. 20, FIG. 22, FIG. 23, FIG. 24 and FIG. 25. The referenced drawings illustrate the assembled or disassembled and exploded perspective views of a preferred drywall crack repair backing plate, (to be herein referred to as the "backing plate") which includes the backing plate as the base member and an integral detachable installation handle, (herein referred tows the "handle") according to a first embodiment of the present invention. As shown in the accompanying drawings, the backing plate, together with its detachable handle of the first embodiment, includes a rectangular, yet planar, palm-of-the hand sized metallic plate-like base member (11) that is approximately 2.0 to 2.25 inches (50.8 to 57.15 cm) on the lesser portion, and 3.0 to 3.25 inches (76.82 to 82.55 cm) on the elongated portion. The backing plate includes a convex semi-cylindrical gutter of-sorts (13) running in a perpendicular direction, and located at the central portion of its body, from the edges of the elongated body portion. The measurement of which is approximately 38.100 mm to 38.125 mm (1.50 to 1.60 inches). Further, the backing plate includes a pair of convex semi-circular loops of sorts (14 & 14A) that arch upward from the body, with each one of the loops being situated near each edge of the embodiment at a right angle to its elongated portion, one located at each end of the concave gutter.

Figure 1:
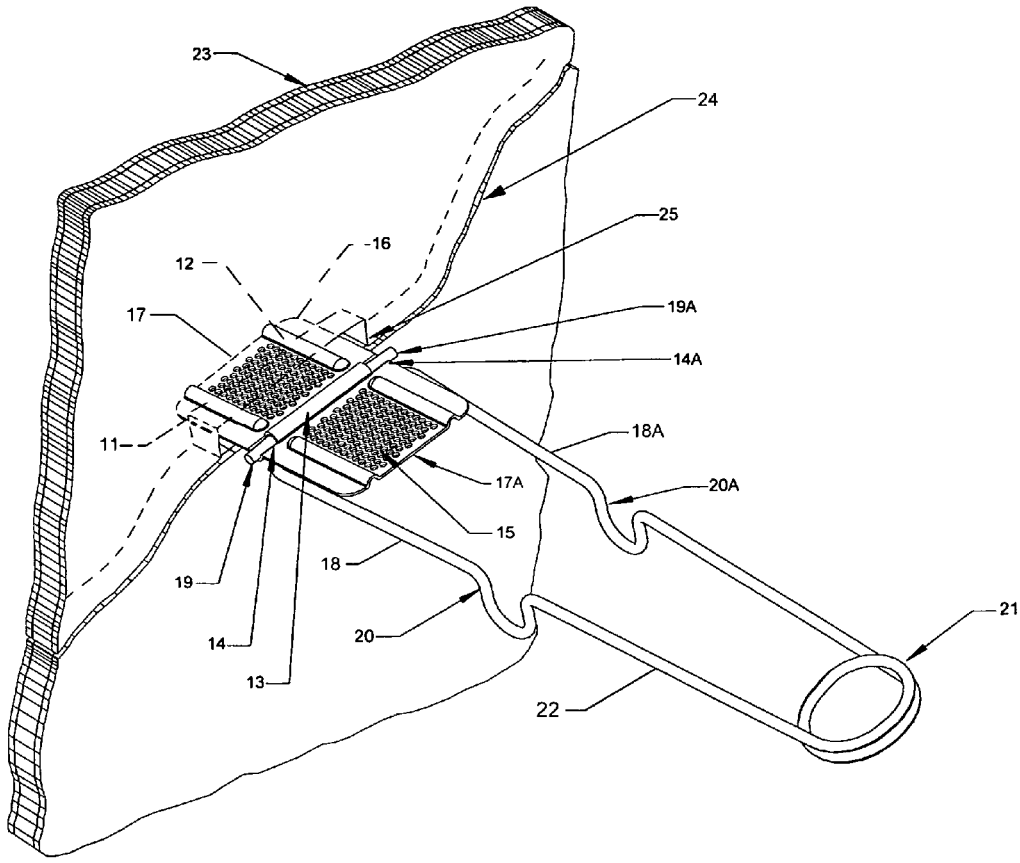
Figure 2:
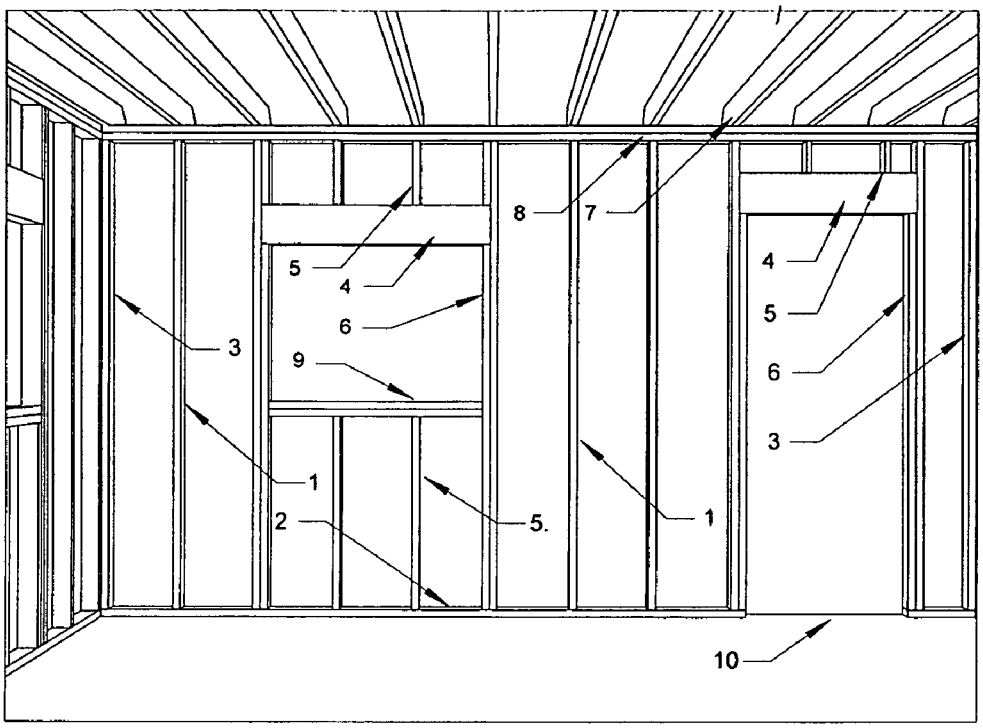
Figure 3:
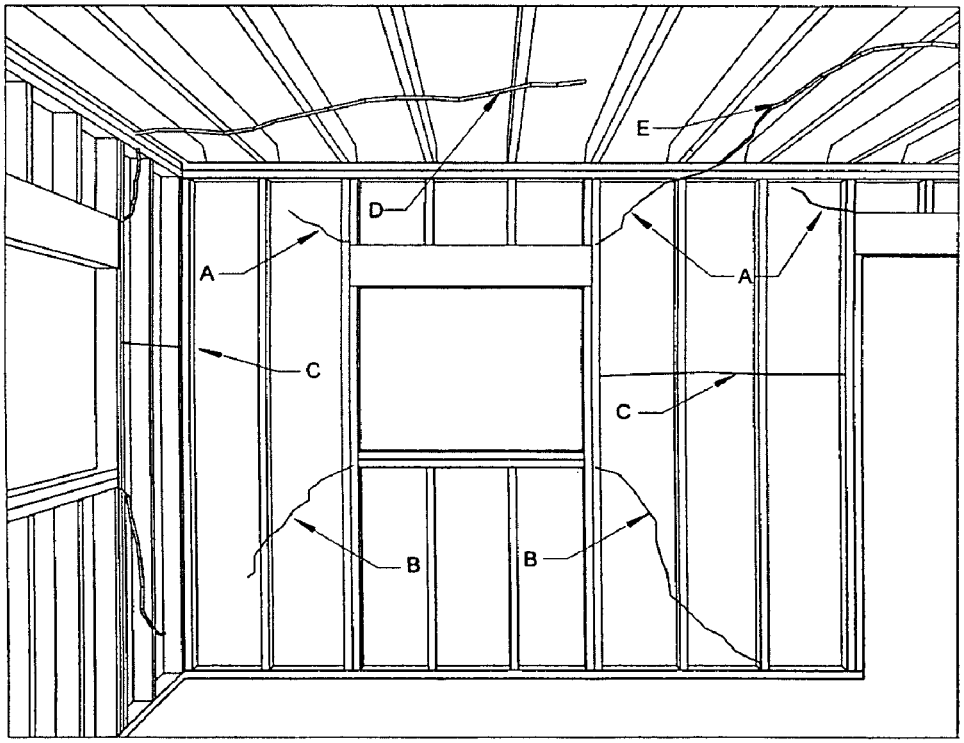

FIG. 1 The backing plate, is to be used in operative positions with the integrated handle temporarily attached to it, may be effectively applied to repair and strengthen the cracked, broken or separated gypsum wallboard panels of walls on the surface of a double-walled partition wall, from within the hidden confines of the wall. That is; the area that is commonly referred to as the blind side, because it will typically have an opposing face of a like kind panel which is fastened to the back side of a partition type wall, which divides the rooms or outer walls, on both sides of the framing members. In the case of ceiling cracks, there may be flooring above from an additional story, or it may be that there is an attic above the ceiling without convenient access space. Such construction situations as were described make it impossible to reach the rear side of the wallboard to make the repair the easy way. And, as it has been explained there is a blind side. Those and other such cracks can be easily and quickly repaired with the use of the backing plate, working together with its handle temporarily attached.

Still referring to FIG. 1, the backing plate 11 is shown being inserted directly through a pre-cut slit 25 in the crack, 24 illustrated in the cut-away drawing example. See also the above FIG. 15 which shows a worker cutting a lengthwise slit into the crack that would allow ample room in which to insert the backing plate through the crack. As it has been mentioned, the backing plate 11 will be temporarily attached to its integral secondary member, the detachable installation handle 22, by joining both the members together at the central axis of the backing plate's body portion at 14 & 14A. When both the backing plate member 11 and the handle member 22 have been joined or assembled, a temporary living hinged mechanism will be created. See FIGS. 4, 16, 17 and 18.

Still referring to drawing FIGS. 1, 4, 16, 17 and 18; a preferred backing plate can be conveniently fabricated or stamped from, approximately 0.3969 mm to 0.7938 mm (0.0156 to 0.0313 inch; 9 to 20 gauge) galvanized sheet metal stock, to deliver the necessary support and strength to the repaired area. Alternately, the backing plate can be fabricated from another type of coated or uncoated rigid metallic material in a distinctly different thickness, or it may be fabricated from a material such as injection molded plastic, plastic combined with nylon, epoxy, polymers or the like; so long as those materials would deliver the type of rigid reinforcement that would be required of a device that would propose to provide the necessary strength and reinforcement in the repaired areas, as would be found in the backing plate of the present invention.

Figure 4:
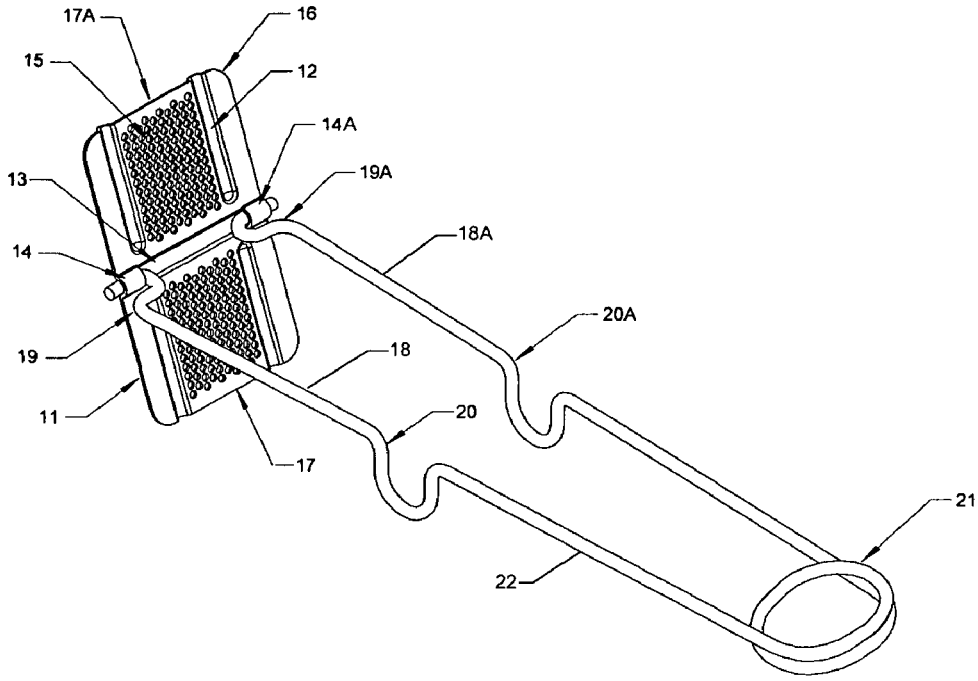
Figure 5:
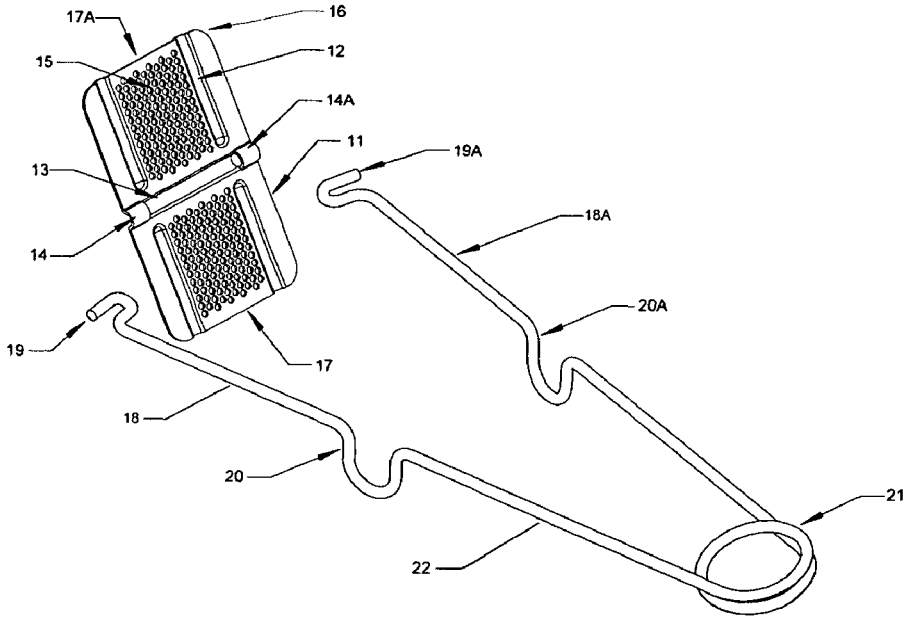
FIG. 5 Is an isometric view showing the Backing Plate and Handle is assembled in the open and ready position.
Figure 6:
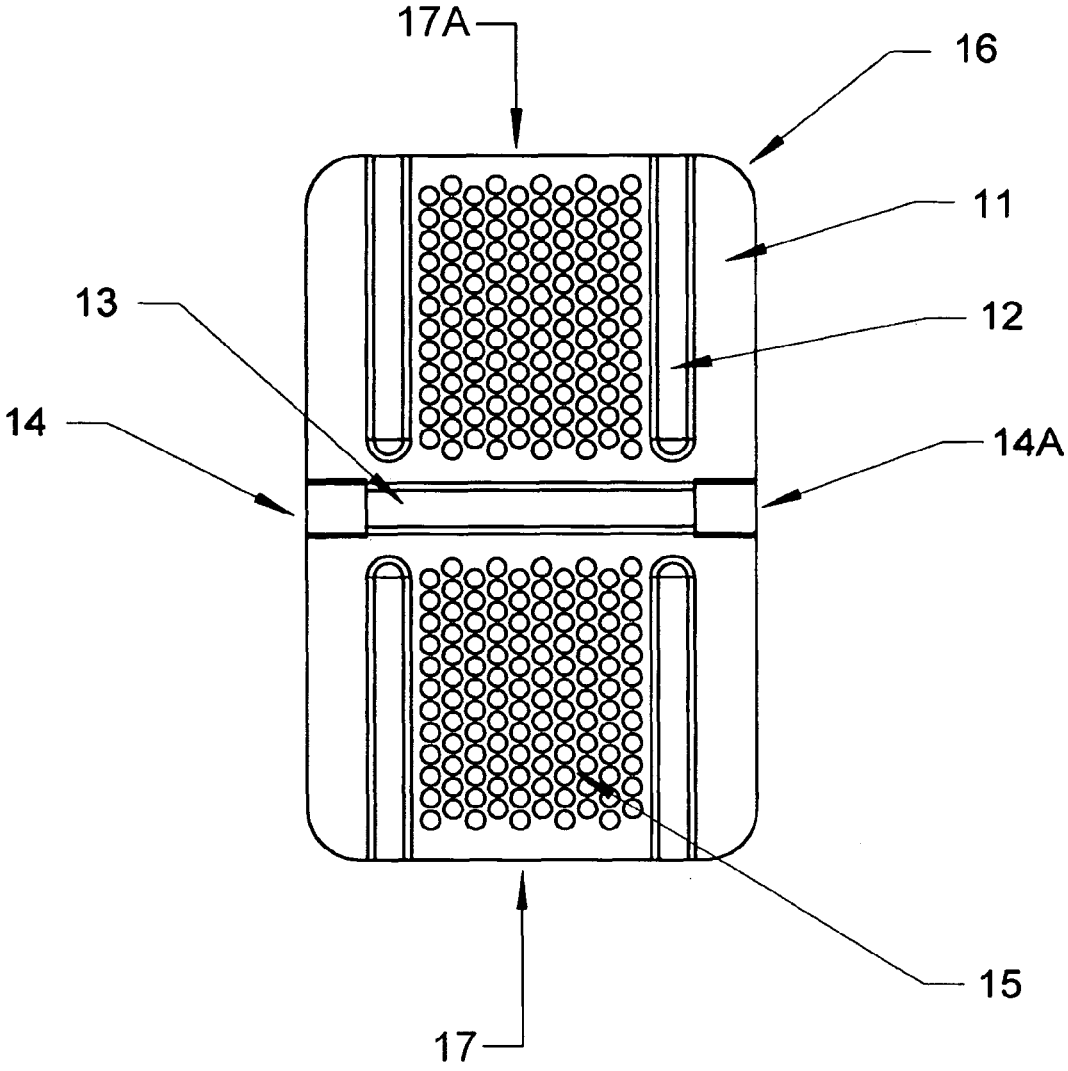
FIG. 6 is a top view of the Backing Plate for a better example of its parts.

Again, making reference to FIG. 1, but now bringing FIG. 4, FIG. 5 and FIG. 6 into focus, the following drawings will help to clarify the described subject matter. As it was mentioned above, it has been determined that a preferred embodiment of the Backing Plate would be that of a convenient rectangular shape which would be relatively planar and elongated 11, and which would fit comfortably in the palm of a worker's hand. See FIGS. 6, 15 and 17. The preferred backing plate embodiment 11 will have a length along both outer edges of 14 & 14A on the elongated sides, lying within the range of about 76.200-79.375 mm (3.0-3.1250 inches). The width of the preferred embodiment on either end edges 17 or 17A would lie in a range of about 47.625-825 mm (1.880-1.900 inches). The overall preferred thickness of the Backing Plate when stamped into its completed configuration would in the range of 2.383-3.1750 mm (0.0938-0.1250 inches) to afford the lowest profile for it to easily pass through the pre-cut slit in the crack 25 without obstruction. It would further be preferable that each of the four corners 16 would be rounded to enhance handling, the radius of which would be about 25.530-550 mm (0.25-30 inches. Alternately, the shape of the backing plate could be change to a square of sorts, instead of the described rectangular shape. Also, the width of the backing plate could be reduced in order to facilitate manufacturing and production requirements; in this instance the width at edges 17 & 17A could be reduced to as narrow as 38.100 mm (1.5 inches) and still be capable of achieving its intended objectives without much loss of integrity.

FIGS. 1, 4, 5, and 6, The preferred backing plate further includes a convexly shaped semi-tubular channel or defined gutter of sorts 13 situated at a right angle to each of the 14 & 14A elongated edges, positioned within the mid-portion of the planar body being situated at its central apex. For easier reference, the loop on the Left Side will be indicated as 14, and the loop on the Right Side will be indicated as 14A, not really mattering which direction the backing plate happens to be turned because both ends will be a mirror image. The preferred channel or gutter 13 will have a desirable length at a point between each of the lesser ends 17 & 17A of approximately 3.5055 mm (1.3801 inches). The backing plate further includes two semi-circular arch shaped loops of sorts 14 & 14A extending upward from the planar body portion, one being situated along each of the two elongated edges 14 & 14A, and at each end portion of the described channel or gutter 13. The preferred width of each of the said arched loops will be in the proximal range of 6.453 mm (0.250 inches).

FIGS. 7 and 8. The preferred diameter of the channel or gutter 13, as well as the preferred upturned loops 14 & 14A will be in the range of about 2.3813-3.1750 mm (0.0938-0.1250 inches), so that when viewing the backing plate of the described configuration as it would be seen from the side, one can clearly see the formation of a tubular appearing channel or a gutter of sorts that has been formed the placement of the upturned loops 14 & 14A, combined with the downward stamped gutter 13, which extends completely through the width of the backing plate 11. Therefore, a pivot point has been established and positioned at the central body portion of the backing plate. Alternately, the channel could be fabricated with variations in the above dimensions, and, the resulting pivot point could be altered to a position it either above or below the mid-line of the body; so long as the general location of the pivot point would not be seriously altered.

Referencing again to drawing FIG. 1, together with FIGS. 4, 5 and 6; the backing plate also includes a pair of concave, spaced apart semi-tubular shaped reinforcement grooves 12, running parallel, at a right angle from the lesser edges of 17 & 17A, each pair of which extends from each described edge toward the direction of the central body portion where the preferred channel or gutter 13 and the preferred loops 14 & 14A are situated; and running the distance of about 33.1434 to 33.11500 mm (1.010 to 1.025 inches). To draw attention to the above referenced drawings, especially to FIG. 6, it can be seen that the planar body has one set of reinforcement grooves located on two of each duplicate sides. Alternately, the reinforcement grooves 13 could be made to run continuous; the entire length of the backing plate through the channel or gutter 13 and along the inside edge of the upturned loops 14 & 14A, thereby crossing the so called gutter 13. This alteration may be advisable in order to facilitate less complex manufacturing steps and improve production, without compromising the pivoting action of the backing plate.

Still referring to FIGS. 1, 4, 5, and 6, a preferred backing plate includes a base which are grouped into a tightly bored mesh of sorts, so situated as to permit easy penetration by self tapping drywall screws used for fastening the backing plate to a drywall panel (to be described). The boring of the apertures or holes would be accomplished by being dye-punched. The mesh of apertures as described lies within the open portion of the backing plate within the spaced apart strengthening grooves 12, with the first row of apertures beginning at a point that is approximately 4.2909 mm (1.689 inches) from each of the 17 or 17A edges. Each of said holes or apertures is approximately 1.9844 to 2.7781 mm (0.0781-0.1094 inches) in diameter. The mesh of holes include multiple such perforations, as mentioned, that include about 10 rows running vertically and about 11 rows running horizontally, with each row being staggered. The pattern of the mesh of apertures 15 is duplicated on the opposite side of the embodiment of the backing plate. Likewise, the reinforcement grooves 12 and the rounded corners 16 as described above are a mirror image. For that reason it does not matter which end of the backing plate is inserted first; either end will be the will be the distal end 17 or 17A edge. The leading edge 17A of the backing plate 11 is first inserted through the lengthwise slit 25 which is to be cut through the crack in line with its traveling direction with the use of a utility knife, (See FIG. 15) approximately 3.9688 mm Wide X 53.975 mm in length, (0.2813×2.1250 inches in length) in order to have an opening that is large enough to pass the backing plate through the opening with little obstructions.

FIG. 4 and FIG. 5. The handle described: In a preferred embodiment, a backing plate includes a secondary but integral embodiment member, the handle 22, as was mentioned above. When joined as directed, a preferred detachable handle creates a pivoting action, living hinged installation assembly. A temporary attached handle may be used for inserting and installing a backing plate 11 through a pre-cut slit 25 in a wallboard crack as described above. It has been determined that the convenient shape of a preferred handle is that of a 'V' shaped "yoke-like" configuration, which includes a circular and open double spring 21 located at the lower central portion of the 'V'. The preferred convenient size of the handle has been determined to be in such a length that would allow it to be comfortably held in the palm of the hand of the average sized adult person, which would also position the double spring 21 to lie close to the base of the palm nearest to the wrist, whereas the small finger could rest on the edge of the double spring for added support.

Still referencing to FIG. 5, the preferred handle includes, a Left Side extension or arm 18, and a Right Side extension or arm 18A. Each of which forms the left and right sides of the 'V' shape. The double open spring that was described above will serve two primary purposes; a) it will exert strong outward pressure, and; b) it will serve as a pulling device to allow the backing plate to be pulled outwardly within the, blind side, confines between the wallboard panels. Each purpose will be described in detail.

The handle continued: The preferred handle 22 includes a pair of specifically designed "hooks" of sorts 19 & 19A, one of each which are located at the ends of the handle's 'V' shaped configuration. In use, the backing plate is to be mounted or attached to the so indicated hooks 19 & 19A, as has been mentioned. When the backing plate and the handle are in the ready position, as shown in FIG. 5 the loop on the Left Side will be 14, and the loop on the Right Side will be 14A, as was described above. Likewise, the hook on the Left Side of the handle will be 19, and the hook on the Right Side of the handle will be 19A. The backing plate would then be attached to the handle by joining both the 14 & 14A loops, with the respective 19 & 19A hooks. The so indicated Left Side Hook 19 will be in the shape of an open letter 'P', with the upper open part forming a prong or distal end pointing outward. The hook on the Right Side 19A will be in the shape of a reversed open letter 'P', also with the upper open part forming a prong or distal end pointing outward. See the example illustrated in FIG. 5. Further, when the handle is positioned as recommended, the hooks will be slightly turned upward to an approximate angle of 36.5125 mm (34.38 degrees), in order for the backing plate to shift upward on its loops 14 & 14A to allow it to lie flat against the handle 22, as well as to provide ample force to allow it to spring open within the wall cavity, yet to be described. See drawing FIG. 20.

FIGS. 1, 4, 5, 8, and FIGS. 18, 19, 20 and 21. A preferred handle 22 further includes a duplicate pair of downward bent 'U'-Shaped formations, which are designed to be used as thumb or forefinger grips, of sorts, with which to guide or hold the handle while in use. The "grip" on the Left Side is indicated as being 20 and the Right Side one being 20A.

FIG. 5 Drawing attention to the overall configuration of the handle, a preferred handle may be fabricated from uncoated spring steel rod of the approximate thickness of; 2.3813 mm to 3.1750 mm (0.0938 to 0.09070 inches@ 11 gauge to 8 gauge). The preferred shapes and bends in the manufacturing process would be made with the use of a wire bending dye. The overall length of the handle from the base of the double spring 21 to the tips of the hooks 19 & 19A would be in the range of about 228.600 mm to 234.350 mm (9.0 to 9.25 inches). The inner radius of the double spring/pull ring is approximately 25.400 mm (1.00 inches). The so indicated thumb or finger grips 20 & 20A would be at a point approximately half the distance from each end, and would be Press-bent downward in the approximate radius of 6.3500 mm to 7.1438 (0.2500 to 0.2813 inches. The outward bent hook tips/distal ends extend approximately 11.1125 mm (0.4375 inches). The "hooks" 19 & 19A would have an opened width of approximately 107.050 mm to 127.000 mm (4.250 to 5.000 inches). Alternately, the handle could be manufactured without such provided grips 20 and 20A. Also, the handle could be manufactured with right angle/90 degree distal end pointing outward on each end of the extensions, rather than the "P" shaped hooks 19 & 19A as was presented; also, hooks do not necessarily be turned upward. None of the alterations would compromise the integrity of the invention.

How to Use the Invention; Detailed Description, Continued: NOTE: Before attempting to repair a crack, certain general procedures will be important to follow; a) locate and mark the locations of wall studs (FIG. 10). b) mark line along crack and mark an 'X' at the termination point (FIG. 11), c) fasten the cracked panel edges to the studs they cross (FIG. 12), d) cut a V groove along the crack to prepare it for final taping and finishing (FIG. 13), e)) mark an 'X' at spaced apart locations along the crack, about one hand width (FIG. 14), f) use a utility knife to cut a length-wise slit into the crack, just large enough to pass the backing plate assembly through the crack. Yes! Cutting a slit is the most important step (FIG. 15).

FIG. 16 A worker would grasp a backing plate 11 to be placed in the palm of one hand. He would hold the backing plate by the thumb and fingers at a slight vertical angle. The channel/gutter 13 should now be in a horizontal position, and the loops 14 & 14A should be facing toward the body of the worker. He would then grasp the handle 22 with the other hand, making certain that its hooks 19 & 19A are facing the direction of the hand holding the backing plate. The thumb or finger grips 20 & 20A should be facing down.

FIG. 17 Then, while still holding the backing plate 11 in the one hand and the handle 22 in the other, the worker would aim the handle and move it toward the gutter 13 of the backing plate. As he does this, he would squeeze in on the grips 20 & 20A to force the hooks 19 & 19A to almost come together; while he simultaneously places the hooks 19 & 19A within the gutter 13. In almost the same maneuver, he would push in and release pressure on the handle. This action will automatically force the distal end of each hook 19 & 19A to be pressed in and locked into each of the respective loops 14 & 14A of the backing plate. The outwardly exerted pressure provided by the spring/ring 21 will hold the backing plate in place while it is being so applied, still being able to pivot on its temporary hinges.

FIG. 18 While still holding the backing plate 11 in the one hand and while holding the handle 22 in the other hand, the worker would then place the fingers of the hand holding the backing plate under the leading edge 17, and lift its edge upward. This action will cause the backing plate to fold over backward (as would be like using a jackknife) in the direction of the other hand, and will cause the underside of the backing plate to press down against the "arms" 18 & 18A of the handle.

FIG. 19 Once it has been folded over, the worker would then press down on the trailing edge of the backing plate 17A with the thumb or finger of the hand holding it down. This action will force the loops 14 &n 14A of the backing plate to shift upward, while the rearward surface of each loop is pressed against the inside edge of the hooks. See FIG. 20 for an Ex-Ray view which illustrates a backing plate being forced through the pre-cut slit of a crack 25. Notice how the backing plate has shifted upward on the distal end 19 & 19A, as it pressed downward on the trailing edge 17A.

FIG. 20 Again referring to FIG. 19; the worker would then insert the backing plate assembly into the pre-cut slit in the cracked wallboard panel 23 from outside the room, and then would push it clear through the crack 24 while using a side-to-side motion until the resistance is no longer felt. This indicates that the trailing edge 17A has cleared the inner wall surface and has likely sprung open within the wall cavity. While pushing the backing plate assembly into the crack, any insulation will be harmlessly pushed out of the way. Also, the rounded corners of the backing plate 16 will help to move obstructions out of the way to facilitate easier passage into the crack, and to avoid tearing the insulation paper.

FIG. 21 Once the backing plate has cleared the inner wall surface, the worker would shift hand positions to insert a finger into the pull ring 21 of the handle. He would then pull outwardly on the handle which will cause the backing plate to be placed flat against the backside of the panel in line with the crack. The hooks 19 & 19A will help to align the backing plate in the desired repair position.

FIG. 22 While the worker continues to hold the backing plate firmly against the inner panel surface with the use of the handle as directed, he would drive a self-tapping drywall screw 26 through the lower cracked panel 24 at a position of about 9.0500 mm (0.0750 inches) away from the crack, and centered at a point which is mid-way between the left and right extensions that contain the 19 & 19A hooks. He would then drive a second drywall screw through the opposite side of the crack in the same manner, making sure to turn the screws tight enough to "dimple" the surface without tearing the drywall paper. Other screws may be put in place as they may be needed, with each screw "dimpled" to provide the smoothest finish FIG. 23 Finally, the worker would once again squeeze the handle 22 by its grips 20 & 20A to force the hooks 19 & 19A to close together, which will dislodge them from their assembled position within the Loops 14 & 14A of the Backing Plate 11. He would, simultaneously pull the handle out of the crack, whereby it will be ready once more to install additional backing plates at spaced apart locations along the crack as needed. Alternately, the spring steel rod material used to form the handle, can be fabricated from a similar metallic material that would deliver the necessary outward exertion.

I claim:

1. A backing plate assembly for repairing walls which include wall panels, the backing plate assembly comprising:

a backing plate having first and second portions, a handle releasably attachable to the backing plate, the handle and the backing plate being separate components when attached to one and other, the handle including a grip which when actuated releases the backing plate from the handle;

a hinge defining an attachment aperture for releasably attaching the handle to the backing plate, at least a portion of the hinge positioned between the first and the second portions of the backing plate, the backing plate being pivotable about the hinge when the handle is attached to the backing plate; and at least a first hole of said first backing plate portion and a second hole of said second backing plate portion being adapted for receiving screws to be driven through at least one wall panel by the handle.

2. The backing plate assembly of claim 1 wherein the at least first and second holes of the backing plate portions define a mesh of holes.

3. The backing plate assembly of claim 1 further comprising a reinforcing groove defined by the backing plate.

4. The backing plate assembly of claim 3 wherein the reinforcing groove runs perpendicularly to the hinge.

5. The backing plate assembly of claim 1 wherein the attachment aperture of said hinge further comprises a pair of pivot loops on opposite sides of the backing plate, at least one of the pivot loops is adapted to accept a portion of the handle.

6. The backing plate assembly of claim 1 wherein the handle further comprises a circular spring and a pair of elongated prongs extending from the spring.

7. The backing plate assembly of claim 6 wherein each of the prongs further comprise an outwardly and upwardly pointing hook adapted to engage the portion of the hinge defined between the portions of the backing plate.

8. The backing plate assembly of claim 6 wherein the circular spring is adapted to accept at least a portion of a finger of a user.

9. The backing plate assembly of claim 6 wherein each of the prongs define a loop adapted to accept at least a portion of a finger or thumb of the user.

10. The backing plate assembly of claim 1 wherein the backing plate is a generally rectangular plate of about 9 to about 20 gauge galvanized sheet metal.

11. The backing plate assembly of claim 1 wherein the backing plate is made of fireproof material.

12. A backing plate assembly for repairing walls which include wall panels, the backing plate assembly comprising:

a backing plate having first and second portions including a generally rectangular plate of about 9 to about 20 gauge galvanized sheet metal;

a handle releasably attachable to the backing plate, the handle and the backing plate being separate components when attached to one and other, the handle including a grip which when actuated releases the backing plate from the handle;

a hinge defining an attachment aperture and attaching the handle to the backing plate, at least a portion of the hinge positioned between the first and the second portions of a backing plate, the backing plate being pivotable about the hinge when the handle is attached to the backing plate;

the handle including a pair of prongs wherein each of the prongs further comprise an outwardly and upwardly pointing hook adapted to engage a portion of the hinge;

a mesh of holes on each of said first and second portions of said backing plate each hole of said mesh being adapted for receiving screws to be driven through at least one wall panel when the backing plate is pulled toward the at least one wall panel by the handle;

a reinforcing groove defined by the backing plate; and the attachment aperture of said hinge defined by a pair of pivot loops.

* * * * *